United States Patent [19]

Petrovich

[11] 4,256,227

[45] Mar. 17, 1981

[54] FROTH FLOTATION METHOD FOR RECOVERING METAL VALUES FROM THEIR ORES BY THIOUREA OR SUBSTITUTED THIOUREA

[76] Inventor: Vojislav Petrovich, 1935, W. Schiller St., Chicago, Ill. 60622

[21] Appl. No.: 32,455

[22] Filed: Apr. 23, 1979

[51] Int. Cl.[3] ..... B03D 1/02

[52] U.S. Cl. ..... 209/166

[58] Field of Search ..... 209/166, 167

[56] References Cited

U.S. PATENT DOCUMENTS

| | | | |
|---|---|---|---|
| 1,304,307 | 1/1921 | Perkins | 209/166 |
| 1,304,859 | 1/1921 | Perkins | 209/166 |
| 1,610,217 | 12/1926 | Elley | 209/166 |
| 1,801,319 | 4/1931 | Moses | 209/166 |
| 1,833,957 | 12/1931 | Thomas | 209/166 |
| 2,052,214 | 8/1936 | Brinker | 209/167 |
| 2,052,274 | 8/1936 | Brinker | 209/166 |
| 2,090,593 | 8/1937 | Jacobson | 209/166 X |
| 2,105,901 | 1/1938 | Brinker | 209/167 |
| 2,139,697 | 12/1938 | Salzberg | 209/166 X |
| 2,330,587 | 9/1943 | Jayne | 209/166 |
| 2,512,669 | 6/1950 | Morrow | 209/167 |
| 2,664,198 | 12/1953 | Hines | 209/166 |

OTHER PUBLICATIONS

Handbook of Chem. & Physics, 31st Edition, 1949, pp. 412, 413, 510, 511, 512, 513.

*Primary Examiner*—Robert Halper

[57] ABSTRACT

Froth flotation method for recovering copper, nickel, silver, mercury, bismuth, and lead values from their ores by applying thiourea or any substituted thiourea in conjunction with hydrochloric, nitric, sulfuric, phosphoric, oxalic, hexacyanoferric (II), thiocyanic, or cyanic acids to obtain pure copper, nickel, silver, mercury, bismuth, and lead concentrates, which comprises; adding to a water suspension of finely divided ore of thiourea, or substituted thiourea, and an adequate amount of the above said acids, and especially for recovering of copper minerals the addition comprises hydrochloric, nitric at a pH 6.5, sulfuric, phosphoric, oxalic, hexacyanoferric (II), cyanic at a pH 7.0 of the mineral slurry; for recovering nickel minerals, thiocyanic acid, i.e., potassium thiocyanate in a neutral pulp of mineral slurry; for recovering silver mineral or native silver, hydrochloric, nitric, or oxalic acid in a slightly acid pulp of mineral slurry at a pH 6–6.5; for recovering mercury minerals hydrochloric or nitric acid, or potassium thiocyanate at a pH 7.0 of the mineral slurry; for recovering bismuth minerals or native bismuth, hydrochloric or nitric acid in a slightly alkaline pulp of mineral slurry at a pH 8.0, by adding sodium hydroxide, ammonia, or alkyl amine, and adding a small amount of sodium chloride; for recovering of lead minerals, nitric acid at a pH 6.5, or potassium thiocyanate in a neutral pulp of mineral slurry, which acting in conjunction activate and levitate in the froth developed by an usual frother and by usual froth flotation procedure the metal values of copper, nickel, silver, mercury, bismuth, and lead minerals are recovered from respective mineral slurries of unaffected gangue minerals as froth concentrates.

7 Claims, No Drawings

FROTH FLOTATION METHOD FOR RECOVERING METAL VALUES FROM THEIR ORES BY THIOUREA OR SUBSTITUTED THIOUREA

This invention relates to the beneficiation of copper, nickel, silver, mercury, bismuth, and lead ores by froth flotation using thiourea or substituted thiourea as collectors.

Accordingly, this invention has a prime object to provide practical and economical processes for the beneficiation of copper, nickel, silver, mercury, bismuth, and lead ores by applying thiourea or substituted thiourea in conjunctive action with hydrochloric, nitric, sulfuric, phosphoric, oxalic, hexacyanoferric(II), thiocyanic, and cyanic acids to obtain pure copper, nickel, silver, mercury, bismuth, and lead concentrates; and especially for recovering of copper minerals by the addition of hydrochloric, or nitric acid which are applied at a pH 6.5, sulfuric, or phosphoric, or oxalic, or hexacyanoferric(II), or cyanic acids are applied at a pH 7.0 of the mineral slurry; for recovering of nickel minerals, thiocyanic acid, i.e., potassium thiocyanate is applied in a neutral pulp of mineral slurry; for recovering silver mineral or disseminated silver, hydrochloric, nitric or oxalic acid is applied in a slightly acid pulp of mineral slurry at a pH 6–6.5; for recovering mercury minerals hydrochloric or nitric acid, or potassium thiocyanate are applied at a pH 7.0 of the mineral slurry; for recovering bismuth minerals or native bismuth, hydrochloric or nitric acid is applied in a slightly alkaline pulp of mineral slurry at a pH 8.0 by adding sodium hydroxide, ammonia, or an alkyl amine, and adding a small amount of sodium chloride if nitric acid is applied; for recovering lead minerals, nitric acid at a pH 6.5, or potassium thiocyanate in a netral pulp of mineral slurry are applied, which acting in conjunction activate and levitate in the froth developed by a usual frother and by usual froth flotation procedure, i.e., by continuous agitating and aerating the pulp of mineral slurry, in which way the metal values of copper, nickel, silver, mercury, bismuth, and lead are recovered from respective mineral slurries as froth concentrates, leaving gangue minerals unaffected by said processes.

The special feature of this invention is the feasibility of recovering separately copper concentrate as well as the nickel concentrate from the same pulp of mineral by thiourea as collector and by changing the copromoter such as hydrochloric, nitric, sulfuric, phosphoric, oxalic, hexacyanoferric(II) or cyanic acids for recovering of copper mineral, to which acids nickel mineral is not responsive; as soon as the copper mineral is recovered, the addition of potassium thiocyanate recovers the nickel mineral. The process of this invention hands the feasibility of selective beneficiation of copper-nickel ores, omitting to furnish to the metallurgy a bulk cooper-nickel concentrate, of which blister copper and a nickel matte is produced. The process of this invention hands the feasibility of selective beneficiation of nickel-cobalt ores, by which method cobalt mineral, pyrite and pyrhotite are unaffected by collector, the thiourea in all combinations with said acids. So, by processes of this invention copper-nickel-cobalt-pyrite complex ores may be successfully treated by froth flotation method because the selectivity of processes of this invention is a great metallurgical achievement. Of coarse, cobalt mineral may be recovered from tailing of such complex ores in another way and with other reagents and froth flotation processes. Thiourea or substituted thiourea in conjunction with thiocyanic acid, i.e., potassium thiocyanate in a neutral pulp of mineral slurry floats nickel mineral. This combination of reagents is specific for nickel minerals, as is the above said reagents combination for copper minerals. If cobalt mineral is present in any ore containing nickel minerals, cobalt mineral will be unaffected. The behavior of cobalt mineral against processes of this invention add in separation nickel from cobalt value, which are so frequently occuring in a same ore. Moreover, said reagent combination is helpful in recovering copper, nickel, cobalt values from ferromagnesian rocks as well as from laterites, i.e. iron oxides earthy materials. Thus, ferromagnesian silicates, such as serpentine, olivine, various pyroxenes, and amphiboles, iron oxides, such as goethite, hematite in laterite, pyrite and pyrhotite in mafic rocks are unaffected, while copper silicate, nickel silicate minerals, as well as oxides, carbonates, sulfides, and arsenides of copper and nickel are floated, because of which pure concentrates of copper, and nickel may be obtained separately, which represents a real metallurgical advantage. Thiourea in conjunction with hydrochloric, nitric or oxalic acid floats disseminated native silver, and silver minerals from their ores while barite, calcite, ankerite, pyrite, and the like minerals are unaffected. Mercury minerals i.e., cinnabar is floated by thiourea in conjunction with hydrochloric or thiocyanic acid, because of which cinnabar may be recovered from the most accompaning minerals. Bismuth minerals or disseminated native bismuth floats by thiourea in conjunction with hydrochloric or nitric acid in an alkaline pulp of mineral slurry. Such a feasibility hands a method for recovering bismuth value from tungsten, tin, and the like ores, which are unaffected by this combination of reagents. Lead minerals are floated by thiourea in conjuntion with nitric or thiocyanic acid, which adds in the concentration of lead mineral from zinc minerals, omitting thus the depressing the zinc mineral by sodium cyanide, and operating the flotation circuit in high alkaline pulp of mineral slurry.

A further object of this invention is to provide a process requiring only one operation, i.e., froth flotation operation to produce a finished concentrate for the metallurgy, by changing reagents combination, and with a reduction in reagent requirements and costs, as well as an increase in mineral recovery. The special feature of this invention is that the change of floatability of metal value is to achieve by changing the acid or respective salts only, as well as the pH value of the pulp of mineral slurry, because of which two or three separate circuits are to operate, thus achieving the maximum benefit of used reagents. A further object is to provide a process which tolerates relatively large amounts of −150 mesh slimes without seriously affecting the reagents consumption or metallurgical results so that desliming and sizing of the feed is less critical. A further object is to provide a process permiting the plant to operate efficiently at lower conditioning time and higher percent of solids levels, i.e., the higher load of machines, which means greater capacity for lower investment.

The processes of this invention greatly improve the selectivity in the froth flotation separation of copper, nickel, silver, mercury, bismuth and lead minerals from most gangue minerals as well as from heavy metal minerals such as of zinc and iron, in which processes thiourea in conjunction with hydrochloric, nitric, sulfuric, phosphoric, oxalic, hexacyanoferric(II), thiocyanic, and cyanic performs excellent results in concentrating copper, nickel, nickel, silver, mercury, bismuth and lead metal values. The processes further reduce the need for close plant control in critical areas such as desliming, sizing, conditioning, and reagent rates, reducing flotation reagent requirements and processing costs.

Highly efficient results and considerable reagent economy have been effected in the practising of this invention when thiourea, or substituted thiourea such as methylisobutyl-carbinol-thiourea, MIBC-thiourea were applied in conjunction with hydrochloric, nitric, sulfuric, phosphoric, oxalic, or potassium ferrocyanide, potassium cyanide for recovering of copper mineral value, or when thiourea or methylisobutyl-carbinol-thiourea were applied in conjunction with potassium thiocyanate for recovering nickel mineral value, or when thiourea or methylisobutyl-carbinol-thiourea were applied in conjunction with hydrochloric, nitric or oxalic acids for recovering silver metal value, or when thiourea or methylisobutyl-carbinol-thiourea were applied in conjunction with hydrochloric, nitric acids, or potassium thiocyanate for recovering mercury mineral value, or when thiourea or methylisobutyl-carbinol-thiourea were applied in conjunction with hydrochloric or nitric acids for recovering bismuth metal value, or when thiourea or methylisobutyl-carbinol-thiourea were applied in conjunction with nitric acid or potassium thiocyanate for recovering lead mineral value.

The carrying out of this invention in accordance with the foregoing principle, the selected ore is ground sized, and then preferably although not necessarily deslimed by washing to remove colloidally dispersed material, and thereafter the sands are diluted to the pulp consistency of generally about 25 percent solids. Thereafter, the pulp was conditioned for several minutes by agitating with an amount of the order 0.01 to 0.05 kg per ton of ore treated of thiourea or methylisobutyl-carbinol-thiourea, and an acid or salt of hereinbefore said acids and salts in an amount of the order that the pH of the mineral slurry with hydrochloric and nitric acid is about 6–6.5, and for sulfuric, phosphoric, and oxalic acids the pH is to be at about 7.0, and for potassium ferrocyanide, and potassium thiocyanate the pH is to be about 7.0 to 8.0. The addition of said acids, i.e., acid radicals, to the pulp of mineral slurry is indispensable, said acids are co-promoters forming presumably addition compounds at the mineral surface, they are not simple pH regulators, the pH is important for the stability of presumed addition compounds and the initiated action of thiourea or substituted thiourea. The pulp of mineral slurry is conditioned for a suitable lenght of time of about 3 to 5 minutes, with or without a small amount of any suitable frother, followed by aeration, and then the flotation is initiated. The usual rougher and cleaner procedure are practised and the procedure of the invention can well be utilized in a close, i.e., cyclic process wherein the spent water of tailings and concentrate products of respective circuits are returned to the process of each circuit after desliming. In this way the needed water for the flotation is recirculated, and overdozed reagents saved and the plant water circulation hold away off the environment water cources.

Summing up, the present invention comprises a method for the beneficiation of copper, nickel, silver, mercury, bismuth and lead ores, and particularly in recovering copper and nickel concentrates from mixed, complex copper-nickel ores as separate high grade copper, and high grade nickel froth concentrates, which comprises comminuting the ore to liberate substantially all the metal value from gangue and adding to the pulp of mineral slurry thiourea or alkyl substituted thiourea, and a adequate amount of an acid such as hydrochloric, nitric, sulfuric, phosphoric, or oxalic acid, or potassium ferrocyanide for copper recovery, which process is adapted to process partially chlorinated, hydrosulfated, phosphated and arsenated copper ores, frequent in oxidized zones and oberburden of copper deposits, or adding potassium thiocyanate for recovering nickel mineral, or adding hydrochloric or nitric or oxalic acid for recovering silver mineral or disseminated native silver, or adding hydrochloric or nitric acid or potassium thiocyanate for recovering mercury mineral, or adding hydrochloric or nitric acid and sodium chloride for recovering bismuth minerals, or adding nitric acid or potassium thiocyanate for recovering lead mineral. All the said metal values are responsive to levitation from siliceous gangue material, oxide or sulfide of iron and zinc. All the respective metal values are collected as froth concentrates.

The following Examples will facilitate a more complete understanding of the present invention. The above discusion as well as the disclosure illustrate my invention in a general way, for a detailed illustration thereof the Examples of preferred embodiments are set fort below.

TABLE 1

| Example ore treated | Co-promoter acid kg/t | Promoter collector kg/t | Feed % of metal | Conc. % of metal | Recovery % conc. | Recovery % tailing |
|---|---|---|---|---|---|---|
| Example 1 | HCl | Thiourea | Cu % | Cu % | Cu % | Cu % |
| Oxidized copper ore | 0.1 kg/t pH 6.5 | 0.05 kg/t | 2.1 | 28.4 | 88.0 | 12.0 |
| Example 2 | $HNO_3$ | MIBC- | Cu % | Cu % | Cu % | Cu % |
| Oxidized copper ore | 0.1 kg/t pH 6.5 | thiourea 0.07 kg/t | 2.1 | 27.2 | 92.0 | 8.0 |
| Example 3 | $H_2SO_4$ | Thiourea | Cu % | Cu % | Cu % | Cu % |
| Silicified copper ore | 0.1 kg/t pH 6.5–7.0 | 0.05 kg/t | 1.6 | 22.1 | 89.0 | 11.0 |
| Example 4 | Phosphoric acid | Thiourea | Cu % | Cu % | Cu % | Cu % |
| Oxidized arsenous copper ore | 0.02 kg/t pH 7.0 | 0.05 kg/t | 1.3 | 16.8 | 93.0 | 7.0 |
| Example 5 | Oxalicacid | Thiourea | Cu % | Cu % | Cu % | Cu % |
| Copper sulfide ore | 0.03 kg/t pH 7.0 | 0.05 kg/t | 1.2 | 26.3 | 90.0 | 10.0 |
| Example 6 | $K_4/Fe(CN)_6$/ | Thiourea | Cu % | Cu % | Cu % | Cu % |
| Copper sulfide ore | 0.05 kg/t pH 7.0 | 0.05 kg/t | 1.2 | 21.6 | 92.0 | 8.0 |

TABLE 1-continued

| Example ore treated | Co-promoter acid kg/t | Promoter collector kg/t | Feed % of metal | Conc. % of metal | Recovery % conc. | Recovery % tailing |
|---|---|---|---|---|---|---|
| Example 7 Nickel sulfide ore | KSCN 0.05 kg/t pH 7.0 | Thiourea 0.05 kg/t | Ni % 2.3 | Ni % 16.4 | Ni % 86.0 | Ni % 14.0 |
| Example 8 Nickel silicate ore | KSCN 0.05 kg/t pH 7.0 | Thiourea 0.03 kg/t | Ni % 1.6 | Ni % 14.8 | Ni % 92.0 | Ni % 8.0 |
| Example 9 Nickel laterite ore | KSCN 0.05 kg/t pH 7.0 | Thiourea 0.04 kg/t | Ni % 1.8 | Ni % 14.2 | Ni % 90.0 | Ni % 10.0 |
| Example 10 Disseminated native silver | $HNO_3$ 0.01 kg/t pH 6.5 | Thiourea 0.02 kg/t | — | — | Ag % 90.0 | Ag % 10.0 |
| Example 11 Mercury ore Cinnabar | $HNO_3$ 0.01 kg/t pH 6.5-6.9 | Thiourea 0.02 kg/t | — | — | Hg % 95.0 | Hg % 95.0 |
| Example 12 Disseminated native bismuth | HCl 0.01 kg/t pH 8.0 | Thiourea 0.02 kg/t | — | — | Bi % 90.0 | Bi % 10.0 |
| Example 13 Lead sulfide ore | KSCN 0.04 kg/t pH 7.0 | Thiourea 0.04 kg/t | Pb % 4.8 | Pb % 68.0 | Pb % 88.0 | Pb % 12.0 |

The Table 1 shows that thiourea and substituted thiourea in conjunction with hydrochloric, nitric, sulfuric, phosphoric, oxalic, hexacyanoferric(II), thiocyanic or cyanic acids used in effecting this invention are excellent combination of reagents for recovering copper, nickel, silver, mercury, bismuth, and lead minerals from their ores. The hexacyanoferric(II), thiocyanic, and cyanic acids are liberated from their potassium salts in a slightly acid pulp of mineral slurry, or are given as such if disposable. In all Examples except Example 2, pine oil, methylisobutyl carbinol, and Milliken Emulsifier 334-10 were applied as frother with great success.

Considering the results, the conclusion is: that not only the ratio of concentration of copper, nickel, silver, mercury, bismuth, and lead is considerably raised, but also is highly performed with thiourea, or substituted thiourea in conjunction with hereinbefore said acids, without which no stable addition products useful in froth flotation are possible or feasible. A feasible froth flotation process is modified, by which the ratio of depressed gangue is considerably lowered by conditioning the pulp of mineral slurry with thiourea or substituted thiourea in conjunction with hydrochloric, nitric, sulfuric, phosphoric, oxalic, hexacyanoferric(II), and cyanic acids for recovering copper metal value, or in conjunction with thiocyanic acid for recovering nickel metal value, or in conjunction with hydrochloric or nitric acid for recovering silver metal value, or in conjunction with hydrochloric, nitric, or thiocyanic acid for recovering mercury metal value, or in conjunction with hydrochloric, or nitric acid for recovering bismuth metal value, or in conjunction with nitric or thiocyanic acid for recovering lead metal value. Therefore, a feasible froth flotation process is modified by which the selective separation and concentration of copper minerals from nickel minerals is feasible, as well as the selective separation and concentration of nickel minerals from cobalt minerals is also feasible, which represents a great metallurgical advantage. By this invention copper-nickel-cobalt complex ores may be treated by froth flotation process which is cheaper and more convenient that by smelting and costly refining. Therefore, the use according to the present invention of thiourea or substituted thiourea in conjunction with hydrochloric, nitric, sulfuric, phosphoric, oxalic, hexacyanoferric(II), thiocyanic, and cyanic acids for accomplishing the purpose of collecting and concentrating copper, nickel, silver, mercury, bismuth, and lead metal values in a process of unaffected gangue minerals as well as the other heavy metal minerals constitutes a marked advance in the art of froth flotation, and is highly advantageous in improving the selectivity of the collector, thus improving the grade of concentrate.

What is claimed is:

1. In concentrating by froth flotation of copper, nickel, silver, mercury, bismuth, and lead metal values from their ores, which includes subjecting of such ore material when finely ground to froth flotation process in the presence of thiourea or methylisobutyl carbinol thiourea, and in the presence of acids selected from the group consisting of hydrochloric, nitric, sulfuric, phosphoric, oxalic, potassium ferrocyanide, potassium thiocyanate and potassium cyanide which additions acting in conjunction form addition compounds a the mineral surface; the step of adding to the mineral slurry an amount of the order from 0.01 to 0.05 kg per ton of ore treated of thiourea, or substituted thiourea, and an amount of the order from 0.01 to 0.1 kg per ton of ore treated of said acids or salts in a slightly acid, neutral, or slightly alkaline pulp of mineral slurry, and an adequate amount of a convenient frother; said additions to aqueous dispersion of ore produce a float product of copper, nickel, silver mercury, bismuth, or lead value by continous agitation and aeration of the aqueous dispersion of mineral slurry; and separating and recovering the said metal values as float concentrate products.

2. In accordance with claim 1, in concentrating by froth flotation of copper valves in the presence of thiourea or methylisobutyl carbinol thiourea, and said acids or potassium ferrocyanide or potassium cyanide in a slightly acid or neutral pulp of mineral slurry, and an adequate amount of a convenient frother; said additions to aqueous dispersion of ore produce a float product of copper valves.

3. In accordance with claim 1, in concentrating by froth flotation of nickel valves in the presence of thiourea or methylisobutyl carbinol thiourea, and said thiocyanate salt in a slightly acid pulp of mineral slurry, and an adequate amount of a convenient frother; said additions to aqueous dispersion of ore produce a float product of nickel valves.

4. In accordance with claim 1, in concentrating by froth flotation of silver valves in the presence of thiourea or methylisobutyl carbinol thiourea, and said hydrochloric, or nitric acid, and an adequate amount of a convenient frother; said additions to the aqueous dispersion of ore produce a float product of silver valves.

5. In accordance with claim 1, in concentrating by froth flotation of mercury valves in the presence of thiourea or methylisobutyl carbinol thiourea, and said hydrochloric, or nitric acid, or potassium thiocyanate, and an adequate amount of a convenient frother; said additions to the aqueous dispersion of ore produce a float product of mercury valves.

6. In accordance with claim 1, in concentrating by froth flotation of bismuth valves in the presence of thiourea or methylisobutyl carbinol thiourea, and said hydrochloric or nitric acid, and a small amount of sodium chloride to in a pulp of mineral slurry made slightly alkaline to a pH of 8.0 and an adequate amount of a convenient frother; said additions to the aqueous dispersion of ore produce a float product of bismuth valves.

7. In accordance with claim 1, in concentrating by froth flotation of lead valves in the presence of thiourea or methylisobutyl carbinol thiourea, and said nitric acid or potassium thiocyanate, and an adequate amount of a convenient frother; said additions to the aqueous dispersion of ore produce a float product of lead valves.

* * * * *